US007417416B2

(12) United States Patent
Rasmus

(10) Patent No.: US 7,417,416 B2
(45) Date of Patent: Aug. 26, 2008

(54) REGULATOR WITH LOAD TRACKING BIAS

(75) Inventor: Todd Morgan Rasmus, Cary, NC (US)

(73) Assignee: International Business Machines Corporation, Armonk, NY (US)

( * ) Notice: Subject to any disclaimer, the term of this patent is extended or adjusted under 35 U.S.C. 154(b) by 209 days.

(21) Appl. No.: 11/263,139

(22) Filed: Oct. 27, 2005

(65) Prior Publication Data

US 2007/0096702 A1 May 3, 2007

(51) Int. Cl.
*G05F 3/16* (2006.01)

(52) U.S. Cl. ..... 323/317; 323/901; 323/316

(58) Field of Classification Search ..... 323/281, 323/265, 273, 274, 275, 280, 901, 316, 317
See application file for complete search history.

(56) References Cited

U.S. PATENT DOCUMENTS 5,625,278 A 4/1997 Thiel et al.
5,945,818 A 8/1999 Edwards
6,046,577 A 4/2000 Rincon-Mora et al.
6,075,351 A 6/2000 Benes
6,188,212 B1 2/2001 Larson et al.
6,211,661 B1 4/2001 Eckhardt
6,333,623 B1 12/2001 Heisley et al.
6,541,946 B1 4/2003 Chen et al.
6,643,151 B1 * 11/2003 Nebrigic et al. ..... 363/59
6,703,815 B2 3/2004 Biagi
2003/0001550 A1 1/2003 Pulkin et al.
2005/0029995 A1 * 2/2005 Benbrik ..... 323/282

* cited by examiner

*Primary Examiner*—Shawn Riley
(74) *Attorney, Agent, or Firm*—Josh G. Cockburn; Dillon & Yudell LLP

(57) ABSTRACT

An electrical circuit that provides accurate, regulated output voltage over a wide range of input voltages, while exhibiting each of three desired characteristics: accuracy across different supply/process/temperature; stability and linearity yielding phase/gain margins; and high (good) power supply rejection ratio (PSRR). The circuit comprises an output node having a load current and an amplifier having a first input coupled to a reference voltage and receiving a bias input current that is a pre-established proportionate size of the load current across the output node, such that a change in the load current results in a proportionate change in the bias input current. The electrical circuit represents a voltage regulator that provides accurate, linear output voltage that is a predictable portion of the reference voltage.

4 Claims, 3 Drawing Sheets

REGULATOR WITH LOAD TRACKING BIAS

BACKGROUND OF THE INVENTION

1. Technical Field

The present invention relates generally to electrical circuit and in particular to voltage regulators and designs thereof.

2. Description of the Related Art

Conventionally, output impedance and thus output voltage of load regulator devices fluctuate due to one or more of a plurality of factors, including changes in temperature or other operating environmental conditions, and/or changes in current, etc. experienced by the circuit. Voltage (or load) regulation, which measures and counters variations in regulator output voltage due to changes in loading is conventionally dependent on output impedance. Those skilled in the art of electrical circuits and circuit design appreciate the need/desire for accurate, linear output characteristics of load/voltage regulator circuits/devices.

In integrated circuit (IC) chip design, for example, the circuit devices that make up the IC chip typically require a pre-set amount of input voltage (falling within some definable range of acceptable voltage) for proper operation of the devices. To reduce the effects of various nonlinearities which otherwise adversely impact the accuracy of the output voltage, most conventional voltage regulator circuits implement negative feedback to set the output voltage. The negative feedback utilizes open loop gain to lower the output impedance and improve load regulation, increasing accuracy of the output voltage. In addition to increased accuracy, negative feedback also lowers other nonlinear effects and improves line regulation, a measurement of the variation in regulator output voltage due to changes in input voltage.

With conventional voltage regulators, certain tradeoffs must be made when implementing negative feedback. Among these tradeoffs are: (1) accuracy of output voltage versus non-linear environmental/circuit factors (e.g., supply/process/temperature); (2) unconditional stability of the feedback loop which yields acceptable Phase/Gain margin and prevents oscillation; and (3) low PSRR (Power Supply Rejection Ratio), a measurement which tracks how much the output moves due to movements in the input supply (observed effects of an AC supply source and/or noise on the input)

With conventional voltage regulator circuits, it is difficult to satisfy all three tradeoffs simultaneously, particularly over a wide input voltage range. However, such a circuit would be extremely desirable.

SUMMARY OF THE INVENTION

Disclosed is an electrical circuit that provides accurate, regulated output voltage over a wide range of input voltages, while exhibiting each of three desired characteristics: accuracy across different supply/process/temperature; stability and linearity yielding phase/gain margins; and high (good) power supply rejection ratio (PSRR). The circuit comprises an output node having a load current and an amplifier having a first input coupled to a reference voltage and receiving a bias input current that is a pre-established proportionate size of the load current across the output node, such that a change in the load current results in a proportionate change in the bias input current. The electrical circuit represents a voltage regulator that provides accurate, linear output voltage that is a predictable portion of the reference voltage.

The above as well as additional objectives, features, and advantages of the present invention will become apparent in the following detailed written description.

BRIEF DESCRIPTION OF THE DRAWINGS

The invention itself, as well as a preferred mode of use, further objects, and advantages thereof, will best be understood by reference to the following detailed description of an illustrative embodiment when read in conjunction with the accompanying drawings, wherein.

DETAILED DESCRIPTION OF AN ILLUSTRATIVE EMBODIMENT

The present invention provides an electrical circuit that provides accurate, regulated output voltage over a wide range of input voltages, while exhibiting each of three desired characteristics: accuracy across different supply/process/temperature; unconditional stability yielding acceptable phase/gain margins; and high power supply rejection ratio (PSRR). The circuit comprises an output node having a load current and an amplifier having a first input coupled to a reference voltage and receiving a bias input current that is a pre-established proportionate size of the load current across the output node, such that a change in the load current results in a proportionate change in the bias input current. In one embodiment, the output of the amplifier is coupled to the gate of a transistor, which is coupled to the output node in parallel with a pair of series-connected input resistors. The electrical circuit represents a voltage regulator that provides accurate, linear output voltage that is a predictable portion of the reference voltage.

Figure 1:
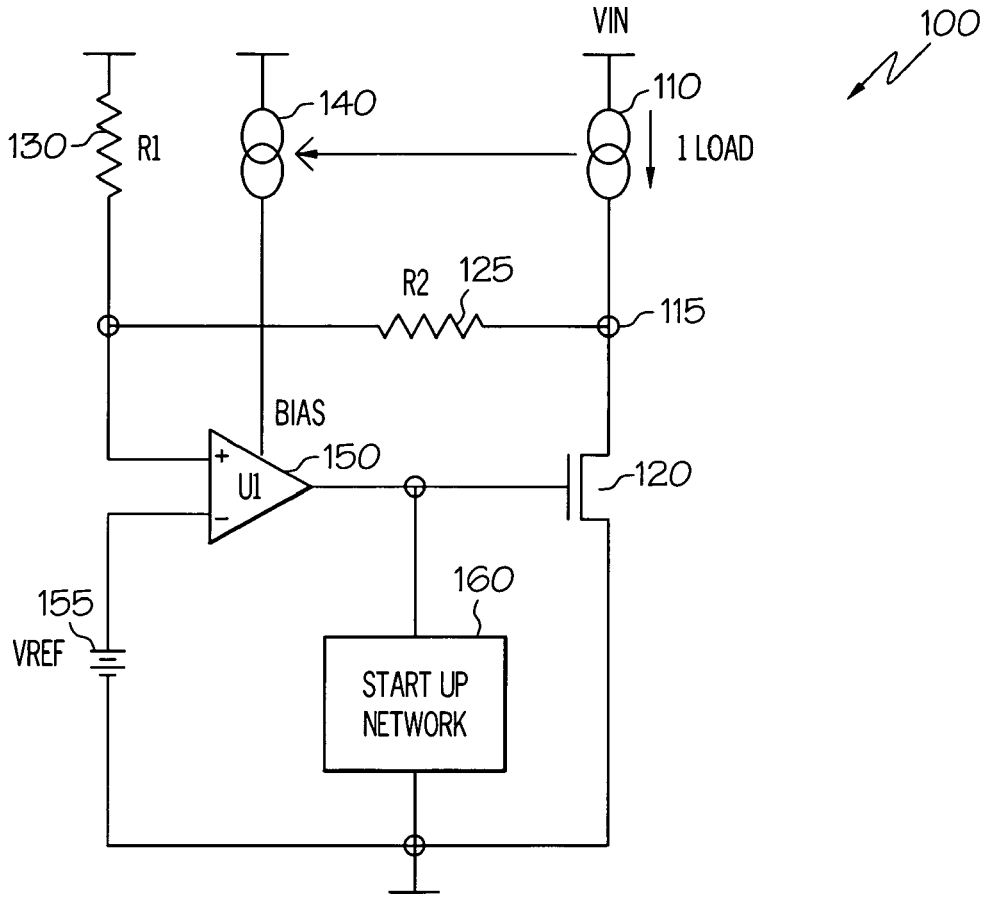
FIG. 1 is a diagram of a voltage regulator circuit designed to provide the functional features of one embodiment of the invention.

With reference now to the figures, and in particular FIG. 1, there is illustrated the basic configuration of the voltage-regulator circuit, designed according to one embodiment of the invention. Circuit 100 comprises an input voltage, Vin, applied to each of the three rails illustrated at the "top" of circuit 100. Circuit 100 also comprises a load current supply, Iload 110, which is the current running through output node 115 and output/pass transistor 120 (when resistors R1 130 and R2 125 are relatively large). The load current supply represents any device that is connected to the output node that causes current Iload 110 to flow. According to the illustrative embodiment, pass transistor 120 is an N-channel CMOS transistor. However, those skilled in the art appreciate that pass transistor 120 may be a bipolar transistor or other type of MOS transistor.

Associated with Iload 110 is a bias current supply, Ibias 140, which is directly linked to Iload 110 (as indicated by the arrow) and provides a current value that is a pre-established proportion/percentage value of Iload 110. That is, Ibias 140 is substantially always a pre-set proportion of Iload 110, and a change in Iload 110 automatically triggers a similar proportionate change in Ibias 140. According to one exemplary embodiment, differences in current amplitudes between Iload 110 and Ibias 140 are determined by relative shapes/sizes of the transistors (i.e., transistor geometry) utilized within the circuits, as described below with reference to FIG. 3. The ratios are thus locked in once the circuit 100 is created with transistors set in place. Also, in a related embodiment, the load current Iload 110 is measured by current flowing thru transistor 120 (with R1 130 and R2 125 relatively large). Exemplary ratios of current sizes between Iload and Ibias are 100:1, 200:1, or 1000:1.

Circuit 100 also includes amplifier 150, which receives as input a reference voltage, Vref 155 and the input voltage less the voltage drop over R1 130. Internal features of amplifier 150 are described in greater details below within the description of FIG. 3. Vref 155 is utilized to determine the size of the output voltage (Vout) across output node 115, and the two voltages are linked via some pre-established proportion (set by resistor ratio), where output voltage is some magnitude (or percentage) higher than Vref 155. According to the illustrative embodiment, the size of Vout is predetermined relative to Vref 155, utilizing Vref 155 and the resistive sizes of R1 130 and R2 125.

Ibias 140 provides a bias input current to amplifier 150, which provides a specific bias voltage across the gate of pass transistor 120 to maintain the correct amount of current flow through pass transistor 120 and thus maintain the voltage at output node 115. Finally, circuit 100 comprises start up network 160 that enables circuit 100 to be placed in an operational state. In some embodiments, start up network 160 may also be utilized to place circuit 100 in a non-operational state at which no voltage regulation occurs.

When changes to the current in the load (Iload 110) are recorded/measured (perhaps due to factors such as process/supply/temperature), amplifier 150 is re-biased by Ibias 140 to improve the linearity of Vout and make Vout more accurate. Utilizing the proportionate changes to Ibias 140 based on measured changes to Iload 110, the biasing of amplifier (U1) 150 as a function of the load current (Iload 110) improves the linearity of amplifier 150 and also reduces the amount of negative feedback required to accurately control the output voltage.

Figure 2:
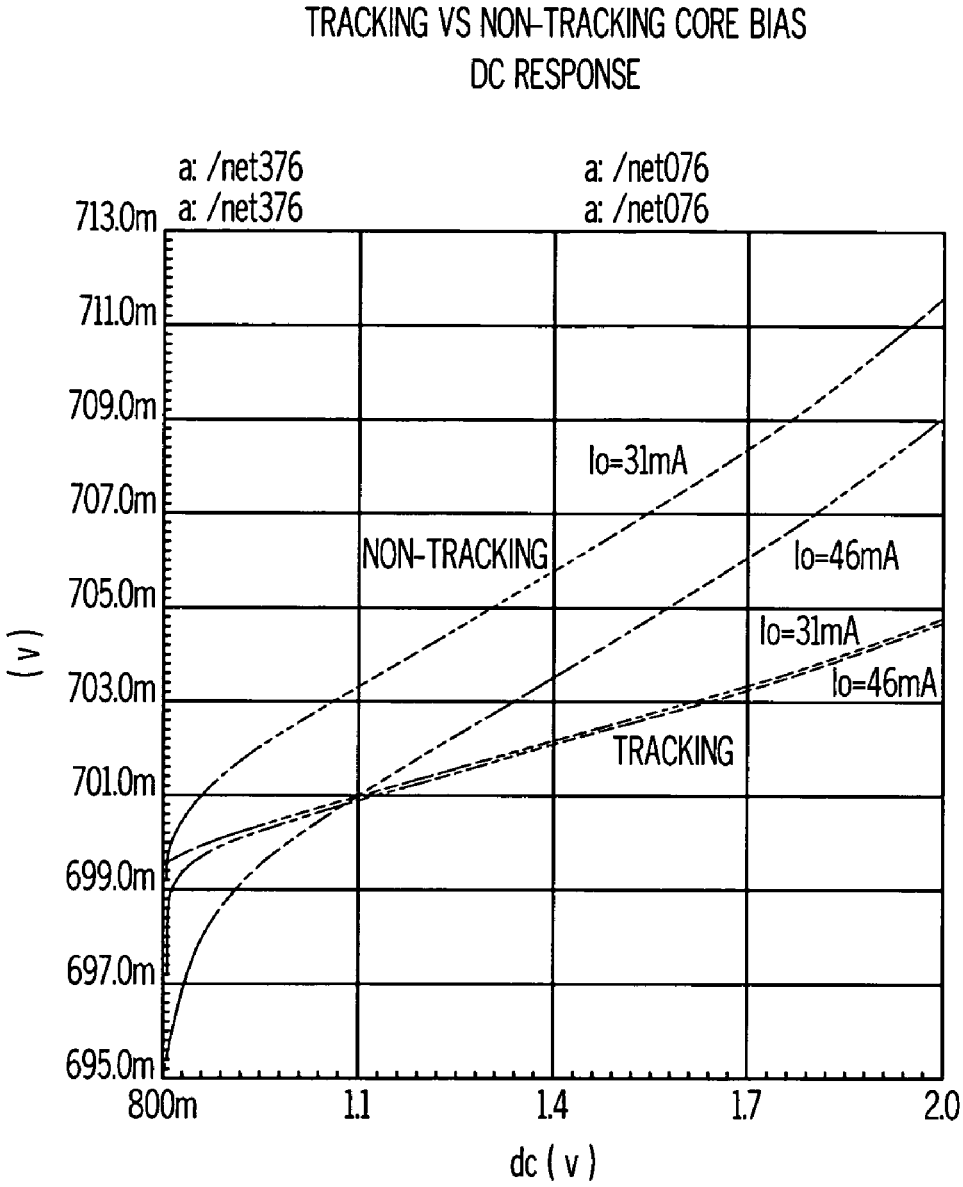
FIG. 2 is a chart illustrating the various changes in output voltage versus input voltage at two different current amplitudes for both a convention voltage regulator with negative feedback and the voltage regulator designed according to FIGS. 1 and 3.

Turning now to FIG. 2, which illustrates a chart by which conventional operation of that voltage regulator with negative feedback mechanism may be compared to operation of the voltage regulator of the present invention. Input voltage is measured along the X axis and output voltage along the Y axis. As shown, input voltage ranges from 0.8V to 2.0V. Two pairs of line mappings are provided, one without tracking (i.e., from conventional load regulator circuits) and another with tracking (from the regulator circuit 100 described herein). Also, each pair of line mappings represent two different output current (Iload 110) values each yielding a different line.

With the non-tracking, conventional circuits, the variance seen along the output voltage (Y axes) ranges between 695 mV/698.5 mV to 709.0 mV/711.5 mV as the input voltage increases from 0.8V to 2V. The lower output current (Iload=31 mA) results in higher output voltages relative to the higher output current (Iload=46 mA). These lines thus indicate a large variance in output voltage for changing input voltage and load current with the conventional circuits.

According to the illustrative embodiment, with the tracking circuit of the present invention, however, the measured change between output voltages is substantially smaller as the input voltage increases from 0.8V to 2V, and the changes in output current (Iload=31 mA to Iload=46 mA) produced almost negligible effects on the output voltage. Notably, also, there is substantially less fluctuation in voltage at the lower end of the input voltage for the circuit of the present invention, when compared to the conventional circuit, which drops off steeply at the lower input voltages. Thus, accuracy is maintained by the circuit of the current invention even at the much lower input voltages, yielding linearity over a larger input range than the conventional systems. In one implementation, the measurable performance differences between the two circuits utilized for the recorded measurements include: (1) improved line regulation from 2% to 0.8%; improved load regulation from 0.35% to a substantially minimal percent; and provide overall regulation improvement from 2.4% to 0.9%. Additionally, the inception of dropout reduces with tracking.

Notably, while specific measurements and results are provided herein, it is understood that those measurements refer to a single circuit and that other similarly configured circuit will yield somewhat different measurements and/or results depending on various factors. Overall, the improvements provided by the circuit of the present invention remain, but may vary in percentage, etc. as different circuits are analyzed.

Figure 3:
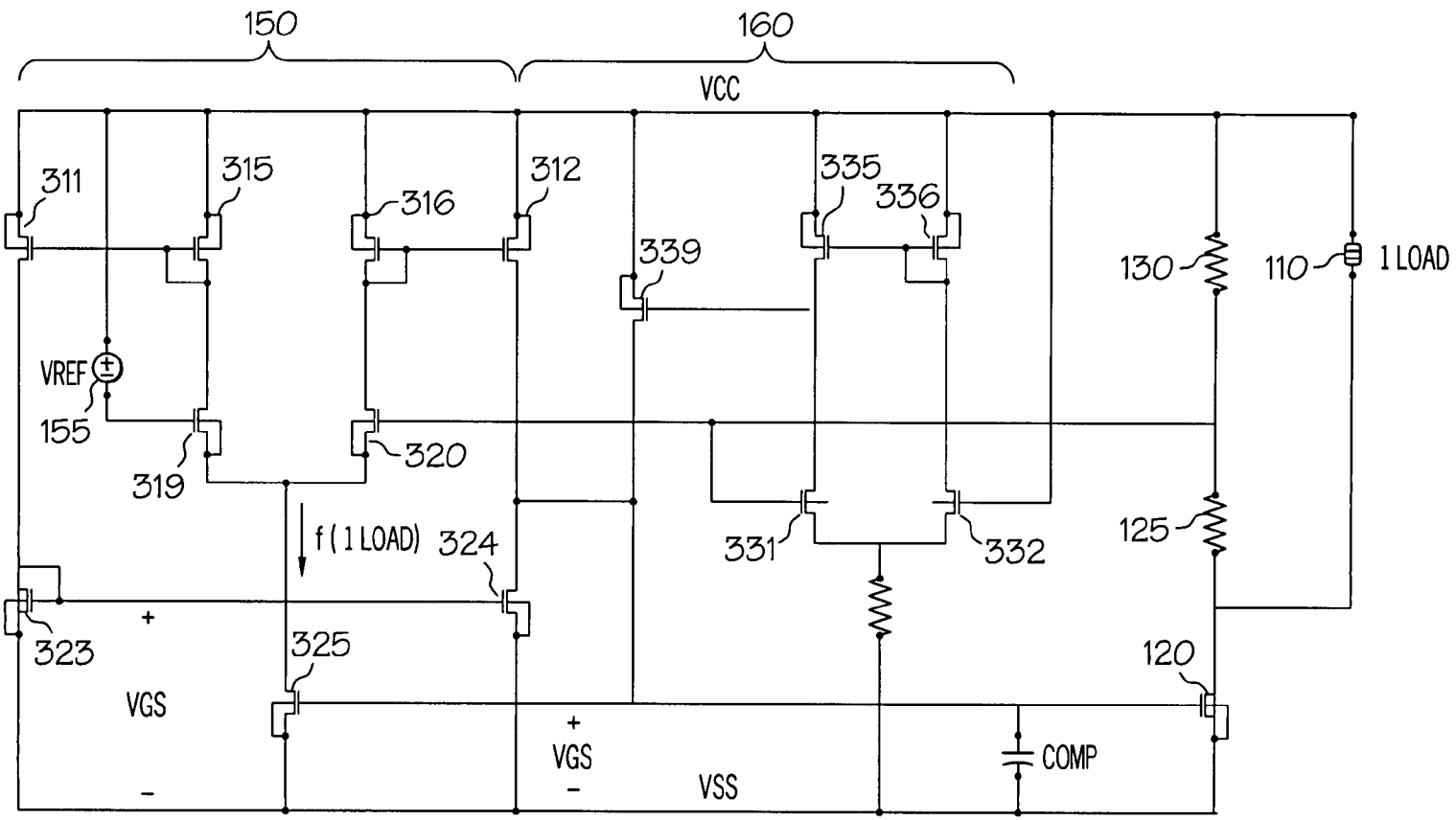
FIG. 3 is a diagram of the internal circuitry of the voltage regulator circuit of FIG. 1, according to one embodiment of the invention.

FIG. 3 provides a more detailed schematic of the internal devices making up the various components of load regulator circuit 100 of FIG. 1. Circuit 100 comprises three main components or groupings of devices, including (1) amplifier (or op AMP) 150, (2) start-up network 160, and (3) output devices 310. Output devices 310 comprise similar devices described above and are indicated with similar reference numerals. Output devices 310 include Iload 110, R1 130 and R2 125 and pass transistor 120. Pass transistor 120 is turned on by the gate-to-source voltage across transistor 120, as described below.

Op AMP 150 comprises a number of transistor pairings, each pairing exhibiting the same drain-to-source voltage. Op AMP 150 also includes a number of differential configured transistors. Each pair of transistors is represented by sequential reference numbers (e.g., 311, 312). First transistor pairing comprises first transistor 311 and second transistor 312 have similar geometry and have the same drain-to-source voltage. Likewise, each other pairing of transistors, namely, transistors 315 and 316, transistors 319 and 320, and transistors 323 and 324 share similar geometries and drain-to-source voltages. The symmetrical configuration of transistor pairings enables a change in Iload 100 to cause a resulting change in the voltage across the transistors, and each pairing tracks each other's voltage so that the voltage across each transistor within the pairing is always the same. This feature further enables linearity in the regulator circuit.

As further shown in FIG. 3, Vref 155 is coupled to the gate of transistor 319. Transistors 315 and 319 are connected in series and are coupled in parallel to series-connected transistors 316 and 320. The drains of transistors 319 and 320 share equally the current Ibias 140, which is the current through the tail transistor 325 and is illustrated as a direct function of Iload, i.e., f(Iload). The gate of output transistor 120 is coupled to the gate of tail transistor 325 so that both gates receive the same voltage and providing the proportional link between the value of Ibias to the value of Iload, as both transistors are activated by the same gate voltage. Also, the geometry and/or shape/size of output transistor 120 is fixed relative to that of tail transistor 325 to provide a determinable proportionate decrease in respective currents (Iload, Ibias) passing through each transistor. Thus, Ibias or tail current flows along the wire into tail transistor 325 and thus biases OP AMP 150 to provide an accurate, stable output voltage. According to one embodiment, both pass transistor and tail transistor are N-channel transistors.

Finally, start up network 160 also comprises two pairs of differential transistors, namely transistors 331 and 332, and 335 and 336, with odd numbered transistors connected in series and even numbered transistors also connected in series. The series connected transistors are then connected in parallel. A fifth transistor 339 provides the output current that creates the voltage across the gates of both pass transistor 120 and tail transistor 325.

The electronic circuit of the illustrative embodiments provides the following design and functional characteristics: (1) improve linearity by tracking geometries of error amp transistors to the geometry of pass transistor; (2) improve linearity of the amplifier by biasing the amplifier as a function of load current, Iload; (3) improve linearity by tracking the geometry of pass transistor, which also improves accuracy and reduces the amount of negative feedback required; (4) reduce the open-loop gain of feedback thus allowing design goals to be met more easily; and (5) enable the bias for the amplifier to track the output regulator load current.

As a final matter, it is important that while an illustrative embodiment of the present invention has been, and will continue to be, described in the context of a fully functional computer system with installed management software, those skilled in the art will appreciate that the software aspects of an illustrative embodiment of the present invention are capable of being distributed as a program product in a variety of forms, and that an illustrative embodiment of the present invention applies equally regardless of the particular type of signal bearing media used to actually carry out the distribution. Examples of signal bearing media include recordable type media such as floppy disks, hard disk drives, CD ROMs, and transmission type media such as digital and analogue communication links.

While the invention has been particularly shown and described with reference to a preferred embodiment, it will be understood by those skilled in the art that various changes in form and detail may be made therein without departing from the spirit and scope of the invention.

What is claimed is:

1. A method for manufacturing a voltage regulator circuit that provides substantially accurate, linear output voltage across a large range of input voltages, said method comprising:

providing an input terminal for receiving an input voltage source;

connecting a device to an output node to generate a load current to a pass transistor having a known dimension;

connecting a pair of series connected resistors between the input terminal for receiving the input voltage source and the output node identified between the load current source and the pass transistor, wherein the first resistor of the pair of series connected resistors is a pre-calculated percentage size of the second resistor of the pair such that a size ratio between the resistors represents the size ratio desired between an output voltage and a reference voltage;

providing an amplifier having (a) a first input terminal coupled between the first resistor and the second resistor, (b) a second input terminal connected to the reference voltage, and (c) an output terminal directly coupled to a gate of the pass transistor;

fabricating the amplifier with a series of paired, parallel transistors that have similar geometries and maintain substantially a same drain-to-source voltage potential, and wherein each pair of parallel transistors track each other's voltage as changes in said voltage is registered by changes in load current;

providing a biased current source that generates a biased voltage across the amplifier, wherein the value of the biased current generated from the biased current source is a pre-determined constant proportion of the load current generated by the load current source such that a change in the load current triggers a same proportionate change in the bias current, whereby a substantially accurate and linear output voltage is measured across the output node;

setting the reference voltage to a value that is a pre-determined proportionate value to a desired output voltage, based on a relative resistive size of said first resistor and said second resistor; and providing a start up network with an output coupled between the output of the amplifier and the gate of the pass transistor, said start up network providing an output current that generates a voltage enabling the circuit to became activated once an input voltage source is applied to the input terminal.

2. The method of claim 1, wherein:

providing a biased current source includes fabricating the circuit with a relative size of a biasing transistor through which the bias current flows and the pass transistor through which the load current flows when the first and second resistors are substantially large, such that the relative size enables the constant, pre-determined proportional value of the bias current relative to the load current; and wherein the constant, pre-determined proportional value of the bias current relative to the load current is provided based on a relative size of a biasing transistor through which the bias current flows and the pass transistor through which the load current flows when the first and second resistors are substantially large, wherein for a specific gate voltage across both the pass transistor and the biasing transistor, the bias current generated is substantially equally to a proportionate size of the load current corresponding to the proportionate size of the biasing transistor relative to the size of the pass transistor.

3. The method of claim 1, wherein the output of the amplifier is the drain of a pass transistor, and wherein the pass transistor and a biasing transistor are N-channel CMOS transistors and wherein the method further comprises coupling the gate of the pass transistor to the gate of the biasing transistor, such that both said pass transistor and said biasing transistor receive a same gate voltage.

4. A circuit device having therein a load regulator circuit configured according to the method of claim 1.

* * * * *